US005967040A

United States Patent [19]

Korthäuer et al.

[11] Patent Number: 5,967,040

[45] Date of Patent: Oct. 19, 1999

[54] LABEL PRINTER

[75] Inventors: Manfred Korthäuer, Mühlheim; Detlef Oldach, Düsseldorf, both of Germany

[73] Assignee: Espera Werke GmbH, Duisburg, Germany

[21] Appl. No.: 09/143,199

[22] Filed: Aug. 31, 1998

[30] Foreign Application Priority Data

Sep. 5, 1997 [DE] Germany ..... 197 38 799

[51] Int. Cl.[6] ..... B41F 1/08

[52] U.S. Cl. ..... 101/288; 101/287; 156/542

[58] Field of Search ..... 101/288, 287, 101/291, 292, 316; 156/542, 361

[56] References Cited

U.S. PATENT DOCUMENTS 3,997,384 12/1976 Kuring et al. ..... 156/269
4,768,435 9/1988 Nimura et al. ..... 101/66

FOREIGN PATENT DOCUMENTS 0309659 7/1988 European Pat. Off. .
0362976 10/1989 European Pat. Off. .
3216258 4/1982 Germany .

*Primary Examiner*—Edgar Burr
*Assistant Examiner*—Anthony H. Nguyen
*Attorney, Agent, or Firm*—Proskauer Rose LLP

[57] ABSTRACT

The invention relates to a printer (1) for printing labels (10) detachably affixed to a carrier strip (5*a*, 5*b*, 5*c*), in particular goods labels, with a label feed unit (12*a*, 12*b*, 12*c*) comprising a wiping head (6*a*, 6*b*, 6*c*) with a support surface by which the label to be printed is supported, as well as a printing device (13) with a print head (8) for printing the label supported by the support surface, as well as with means (9) for conveying the label which has been separated from the carrier strip and printed, away to the goods. To be able to use different label styles with a single printer and a single printing device, it is provided that at least two separate label feed units (12*a*, 12*b*) are allocated to the printer (1), with the support surfaces, of which there are at least two, on the one hand, and the print head (8) on the other hand being movable relative to each other in such a way that one of the support surfaces is in the print position.

12 Claims, 2 Drawing Sheets

LABEL PRINTER

The invention relates to a printer for printing labels detachably affixed to a carrier strip, in particular goods labels, with a label feed unit comprising a wiping head with a support surface by which the label to be printed is supported, as well as a printing device with a print head for printing the label supported by the support surface, as well as with means for conveying the label which has been separated from the carrier strip and printed, away to the goods.

A printing device of this type is known from practical application. DE 32 16 258 A1 relates to a portable label device for affixing and delaminating printed labels which are arranged one behind the other on a carrier strip.

Furthermore, a device with a multitude of permanent label supply units is known from U.S. Pat. No. 3,997,384.

One disadvantage of such known printing devices is the necessity, when different label information is required, e.g. a label whose colour, graphics or writing vary, of manually exchanging the carrier strip with the labels (coupon roll). This prevents continuous operation if more than one type of label is to be written on, in particular if the choice of information is determined only from parameters available immediately before writing the label, as may for example be the case where a printer is combined with a weighing device. In such a combination it can be desirable, for certain weights of automatically-weighed items, to use a particular style of label onto which the measured weight is then printed. In this the required style may vary from one item to the next. This means that in the most unfavourable case a change of coupon roll would become necessary; effectively preventing economical labelling.

U.S. Pat. No. 4,768,435 proposes a possibility for ensuring operation without any interruptions even when different styles are used. To this effect, two printers are used for printing two different styles. However, this alternative takes up significantly more space than a printing device comprising one printer and it also makes the device significantly more expensive.

Further devices for printing several styles without the necessity for changing the style rolls are described in EP 0 309 659 and in EP 0 362 976. The devices of both printed publications make do with a single printer. In both cases however, pieces of paper are printed which after printing are cut off. This makes it possible to pull forward the end of a respective roll of paper stock, lead it to the printer, cut it off and after printing push the free end back again before subsequently selecting the end of another roll of paper stock.

However, such an approach is not possible if instead of paper strips, self-adhesive labels fixed to a carrier strip are to be printed instead of paper pieces, because after printing and wiping a label, the carrier strip from which the label was removed remains and must be accommodated again. In addition, neat printing requires that the carrier strip be guided under tension at all times.

It is thus the object of the invention, with a printer of the type described in the introduction to provide the possibility of printing various label types with each label type being allocated a carrier strip; without the necessity of having to change carrier strips with labels on them or having to use several printing devices.

According to the invention, in the case of a printer with the characteristics of the precharacterising part, this object is met in that at least two separate label feed units are allocated to the printer, with the support surfaces, of which there are at least two, on the one hand, and the print head on the other hand being movable relative to each other in such a way that one of the support surfaces is in the print position.

The device according to the invention has the advantage that various label styles can be used with a single printer and a single printing device. For example, packages below a specified weight can be labelled with a label which has been preprinted with an allocated article designation, a certain base price etc., which label differs from that for packages above this weight limit. In addition, the solution according to the invention allows check weighing and price distinction by means of individual labels. The advantage is not limited to the possibility of using several different label styles but it may also be provided that several carrier strips with identical labels are used and that the printer at the end of a carrier strip comprising labels automatically switches to another carrier strip, so that production need not be interrupted in order to change the carrier strips comprising labels.

A preferred embodiment of the printer according to the invention provides a particularly simple and reliable option of feeding the carrier strips to the wiping heads; in which each of the label feed units of which there are at least two comprises an unspooling reel for unspooling a coupon roll comprising the carrier strip and the labels detachably affixed to it, a spooling reel for spooling the carrier strip free of labels, and a wiping head. Such a design variant also makes it possible to guide the carrier strips over the wiping head under tension so that the labels are positioned flat and straight and can be printed neatly.

Preferably the printer is a thermal printer in which the thermal strip prints the temperature-sensitive labels by local heating. However, the printer according to the invention can also be based on another printing process such as thermal transfer, inkjet, matrix or a laser printing process.

In a preferred embodiment of the invention, in addition, the wiping heads are fixed and the print head is movable. It can be positioned above the wiping head over which the particular label presently required is guided for printing. This allows a simple feed option for the carrier strips because there are no movements relative to each other, of the individual elements within a label feed unit.

Alternatively it is however also possible that the print head is fixed and that at least one of the wiping heads is movable, in which case preferably all wiping heads are movable together.

The arrangement of the wiping heads of which there are at least two is preferably in line.

However, an alternative arrangement of the wiping heads of which there are at least two, along a sector path or a curved path enables a simpler design of the means for conveying the label away to the goods after the said label has been removed from the carrier strip and printed.

Below, the printing device according to the invention is illustrated in more detail by means of drawings showing exemplary embodiments, as follows:

FIG. 1 shows a printer (1) which allows simultaneous use of three different label types.

Figure 1:
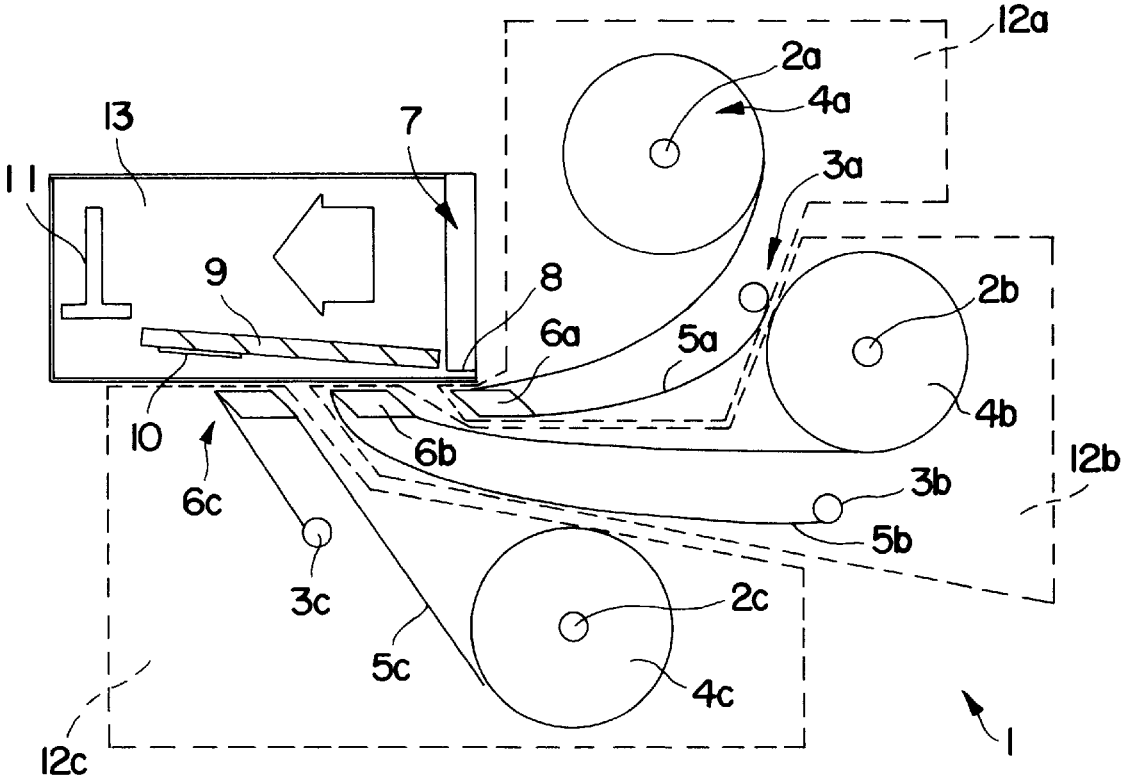
FIG. 1 shows a first embodiment of a printer according to the invention with a movable printing device.

The printer (1) comprises three label feed units (12*a*, 12*b*, 12*c*), each comprising an unspooling reel (2*a*, 2*b*, 2*c*) a spooling reel (3*a*, 3*b*, 3*c*) and a wiping head (6*a*, 6*b*, 6*c*). Each of these unspooling reels (2*a*, 2*b*, 2*c*) accommodates a coupon roll (4*a*, 4*b*, 4*c*) comprising a carrier strip (5*a*, 5*b*, 5*c*) and associated labels. The carrier strip (5*a*, 5*b*, 5*c*) is deflected to a spooling reel (3*a*, 3*b*, 3*c*) by way of the wiping head (6*a*, 6*b*, 6*c*) allocated to the same label feed unit (12*a*, 12*b*, 12*c*). The three wiping heads (6*a*, 6*b*, 6*c*) comprising support surface and wiping edge are arranged in line behind each other. Apart from the label feed units (12*a*, 12*b*, 12*c*) a printing device (13) slidable in the direction of, or against, the arrow shown is also provided, with the said slidable printing device comprising a thermal strip (7) and a label conveyor (9) extending from the thermal strip (7) to a stamp (11). Here the thermal strip (7) is positioned vertically above the first wiping head (6*a*) so that the print head (8) is opposite the support surface of the first wiping head (6*a*). The thermal strip (7) which in FIG. 1 is arranged in vertical position to save space, can alternatively also be arranged in horizontal position.

The printer (1) operates as follows: the printing device (13) is moved from its current position in such a way a that the print head (8) of the thermal strip (7) is precisely placed in print position above the support surface of the wiping head (6*a*, 6*b*, 6*c*) above which the carrier strip (5*a*, 5*b*, 5*c*) of the selected coupon roll is guided. During the movement in, /opposite to, the direction of the arrow, the printing device (13) may possibly be raised somewhat and lowered again after completion of the movement. A label, not yet printed, is present at the support surface of the wiping head (6*a*, 6*b*, 6*c*). The temperature-sensitive label is now printed in the known manner by the print head (8) of the thermal strip (7), as a result of local heating. As a result of the movement of the carrier strip (5*a*, 5*b*, 5*c*) in the direction of the spooling reel (3*a*, 3*b*, 3*c*) the label subsequently separates from the carrier strip (5*a*, 5*b*, 5*c*) at the wiping edge of the wiping head (6*a*, 6*b*, 6*c*) and is taken up by the label conveyor (9) which can for example comprise a suction foot or a suction belt, and conveyed to the stamp (11). In this, the path of the label conveyor (9) is such that no collision between the label and the other wiping edges occurs. Now the next label, still unprinted, is present at the support surface of the wiping head (6*a*, 6*b*, 6*c*). Affixing the printed label (10) to the item (not shown) to be labelled takes place in FIG. 1 with a stamp (11). Instead of a stamp however, any other type of labelling system may be used, such as for example affixation with a sealing arm or with a blowing system.

Figure 2:
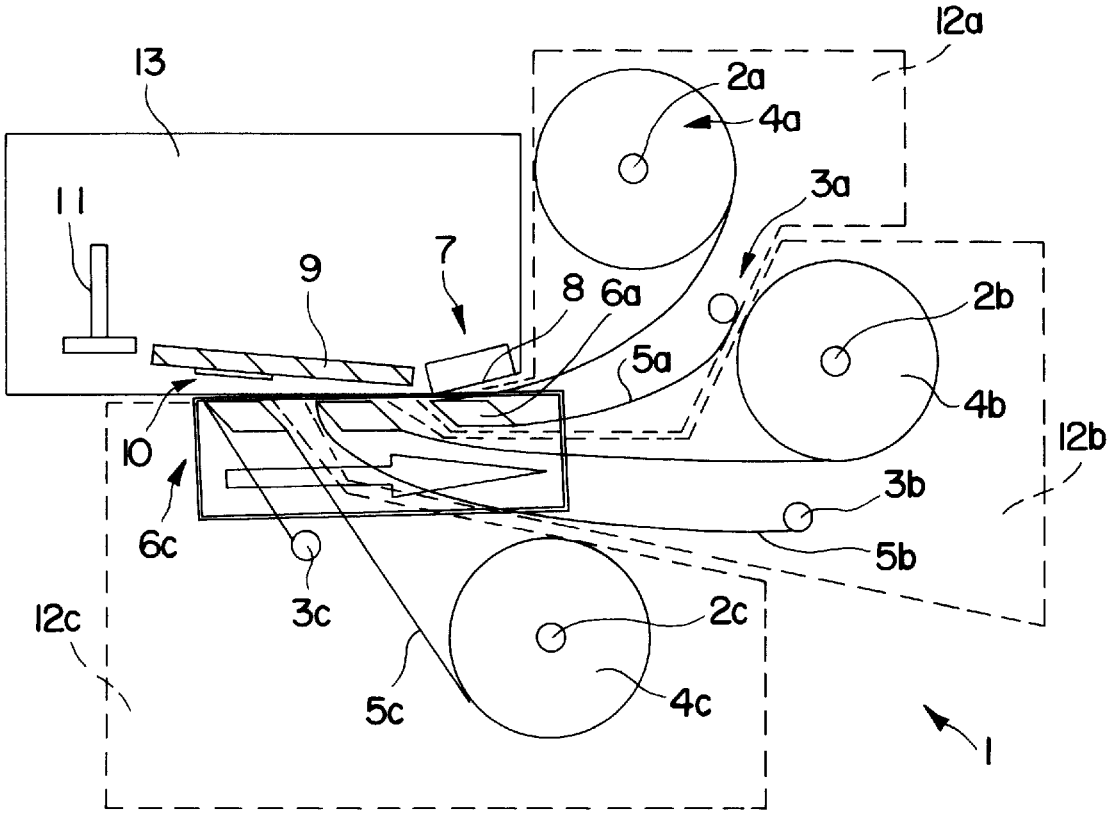
FIG. 2 shows a second embodiment of a printer according to the invention with movable wiping heads.

FIG. 2 shows a second embodiment according to the invention of a printer (1) which embodiment enables simultaneous use of three different types of labels.

The printer (1) comprises the same elements as the printer from FIG. 1, with their interaction also being the same.

Contrary to the wiping heads of the printer from FIG. 1, here however the in-line wiping heads (6*a*, 6*b*, 6*c*) are together slidable in the direction of, or against, the arrow shown. By contrast, the printing device (13) is fixed in a stationary manner in the embodiment of FIG. 2.

As was already mentioned in the case of FIG. 1, the thermal strip need not necessarily be arranged in a vertical position. In FIG. 2 the thermal strip (7) is positioned horizontally above the first wiping head (6*a*) so that the print head (8) is opposite the support surface of the wiping head (6*a*).

The printer (1) from FIG. 2 functions as follows:

The totality of the wiping heads (6*a*, 6*b*, 6*c*) is moved from its actual position in such a way that the support surface of the wiping head (6*a*, 6*b*, 6*c*) by which the desired carrier strip (5*a*, 5*b*, 5*c*) is guided, is precisely placed in print position below the print head (8) of the thermal strip (7). During the movement in, /opposite to, the direction of the arrow, the printing device (13), with the stationary printing device used here, may possibly also be raised somewhat and lowered again after completion of the movement. Further operation is analogous to that described in FIG. 1.

List of Reference Numbers

1 Printer
2*a* First unspooling reel
2*b* Second unspooling reel
2*c* Third unspooling reel
3*a* First spooling reel
3*b* Second spooling reel
3*c* Third spooling reel
4*a* First coupon roll with carrier strip and labels
4*b* Second coupon roll with carrier strip and labels
4*c* Third coupon roll with carrier strip and labels
5*a* First carrier strip
5*b* Second carrier strip
5*c* Third carrier strip
6*a* First wiping head with support surface and wiping edge
6*b* Second wiping head with support surface and wiping edge
6*c* Third wiping head with support surface and wiping edge
7 Thermal strip
8 Print head
9 Label conveyor
10 Label
11 Stamp
12*a* First label feed unit
12*b* Second label feed unit
12*c* Third label feed unit
13 Printing device

We claim:

1. A printer for printing labels detachably affixed to a carrier strip, the printer comprising:

at least two label feed units;

at least two wiping heads presenting support surfaces for supporting the labels during printing;

a printing device having a print head for printing the labels supported on each of the support surfaces;

means for conveying printed labels which are separated from the carrier strip; and the support surfaces and the print head being movable relative to one another to bring a given one of the support surfaces to a printing position.

2. A printer according to claim 1, wherein:

the carrier strip and the labels detachably affixed thereto are configured as a coupon roll receivable in each of the label feed units;

each of said label feed units including an unspooling reel for unspooling the coupon roll when received therein, a spooling reel for spooling the carrier strip free of the labels, and one of said wiping heads.

3. A printer according to claim 1, wherein said printer is a type selected from the group consisting of thermal, thermal transfer, inkjet, matrix and laser.

4. A printer according to claim 1, wherein the wiping heads are fixed and the print head is movable.

5. A printer according to claim 1, wherein the print head is fixed and at least one of the wiping heads is movable.

6. A printer according to claim 5, wherein all of said wiping heads are movable as a unit.

7. A printer according to claim 4, wherein the wiping heads are arranged in-line.

8. A printer according to claim 4, wherein the wiping heads are arranged along a sector path.

9. A printer according to claim 4, wherein the wiping heads are arranged along a curved path.

10. A printer according to claim 5, wherein the wiping heads are arranged in-line.

11. A printer according to claim 5, wherein the wiping heads are arranged along a sector path.

12. A printer according to claim 5, wherein the wiping heads are arranged along a curved path.

* * * * *